United States Patent [19]

Blanchard

[11] 4,310,285

[45] Jan. 12, 1982

[54] FOLDING PROPELLER WITH RUBBER HUB

[75] Inventor: Clarence E. Blanchard, Kenosha, Wis.

[73] Assignee: Outboard Marine Corporation, Waukegan, Ill.

[21] Appl. No.: 93,400

[22] Filed: Nov. 13, 1979

Related U.S. Application Data

[62] Division of Ser. No. 859,052, Dec. 9, 1977, Pat. No. 4,204,806.

[51] Int. Cl.[3] ..... B63H 1/24

[52] U.S. Cl. ..... 416/134 R; 416/93 A; 416/142

[58] Field of Search ..... 416/134 R, 142 R, 142 A, 416/93 A, 169 R; 64/28 R

[56] References Cited

U.S. PATENT DOCUMENTS

| | | | |
|---|---|---|---|
| 2,111,245 | 3/1938 | Irgens | 416/134 X |
| 3,002,365 | 10/1961 | Liljequist | 416/134 X |
| 3,113,625 | 12/1963 | Conover | 416/169 |
| 3,563,670 | 2/1971 | Knuth | 416/134 R UX |
| 3,764,228 | 10/1973 | Shook | 416/93 A |
| 3,871,324 | 3/1975 | Snyder | 416/134 R X |
| 3,876,331 | 4/1975 | Denherder et al. | 416/134 X |
| 4,086,025 | 4/1978 | Astrand | 416/142 A |
| 4,095,919 | 6/1978 | Ehrenskjold et al. | 416/142 A |
| 4,204,806 | 5/1980 | Blanchard | 416/134 R |

FOREIGN PATENT DOCUMENTS

| | | | |
|---|---|---|---|
| 2355809 | 5/1974 | Fed. Rep. of Germany | 416/142 A |
| 1268577 | 3/1972 | United Kingdom | 416/142 A |
| 1291202 | 10/1972 | United Kingdom | 416/142 A |

*Primary Examiner*—Everette A. Powell, Jr.

*Attorney, Agent, or Firm*—Michael, Best & Friedrich

[57] ABSTRACT

Disclosed herein is a foldable propeller assembly adapted for connection to a drive shaft. The propeller assembly includes a propeller carrier having an open end portion defining an axially extending mounting socket for receiving the drive shaft and a hub end portion spaced from the open end portion. A pair of propeller blades are pivotally mounted on the hub end portion for movement from a folded-together, collapsed position to a radially outwardly extending operative position in response to rotation of the propeller carrier and for movement from the operative position to the collapsed position in response to cessation of rotation of the propeller carrier. The assembly also includes drive means for drivingly connecting the propeller carrier with the drive shaft for common rotation therewith, the drive means further including a resilient member interposed the mounting socket and the drive shaft for absorbing torque forces transmitted from the propeller carrier to the drive shaft when the propeller blades are moved from the collapsed position to the operative position in response to common rotation of the drive shaft and the propeller carrier.

10 Claims, 7 Drawing Figures

FOLDING PROPELLER WITH RUBBER HUB

This is a division of application Ser. No. 859,052 filed Dec. 9, 1977, now U.S. Pat. No. 4,204,806.

BACKGROUND OF THE INVENTION

This invention relates to marine propellers, and more particularly, to a foldable marine propeller assembly.

Foldable marine propellers which employ a pair of pivotally mounted blades that move between a trailing, collapsed position and an outflung drive position are known. Such foldable marine propellers are commonly connected to a drive shaft by a shear pin to avoid damage to the drive shaft should excessive torque forces be developed. Representative prior art constructions of foldable propellers are disclosed in the following U.S. patents:

Learnard, U.S. Pat. No. 725,097—Apr. 14, 1903
Godfrey, U.S. Pat. No. 2,608,257—Aug. 26, 1952
Beck, U.S. Pat. No. 3,255,826—June 14, 1966
Butler, U.S. Pat. No. 3,591,311—July 6, 1971
Lorenz, U.S. Pat. No. 3,709,634—Jan. 9, 1973
Kettner, U.S. Pat. No. 3,715,171—Feb. 6, 1973
Ehrenskjold et al, U.S. Pat. No. 3,981,613—Sept. 21, 1976
Beck, U.S. Pat. No. 3,982,853—Sept. 28, 1976

The abrupt opening of the foldable propeller blades to the operative position can in itself create reactive torque forces that are sufficiently large to fracture the shear pin. None of the above patents discloses a means for absorbing this reactive force to lessen the chance of fracturing the shear pin under these circumstances.

SUMMARY OF THE INVENTION

The invention provides a foldable propeller assembly adapted for connection to a drive shaft, which propeller assembly includes a propeller carrier having an open end portion defining an axially extending mounting socket for receiving the drive shaft and a hub end portion spaced from the open end portion. A pair of propeller blades are pivotally mounted on the hub end portion for movement from a folded-together, collapsed position to a radially outwardly extending operative position in response to rotation of the propeller carrier and for movement from the operative position to the collapsed position in response to cessation of rotation of the propeller carrier. The propeller assembly further includes drive means for drivingly connecting the propeller carrier with the drive shaft for common rotation therewith, the drive means including a resilient member interposed the mounting socket and the drive shaft for absorbing torque forces transmitted from the propeller carrier to the drive shaft when the propeller blades are moved from the collapsed position to the operative position in response to common rotation of the drive shaft and the propeller carrier.

In accordance with the preferred embodiment of the invention, the drive means includes a sleeve member having an axially extending bore for rotatably receiving the drive shaft and a drive pin drivingly connecting the sleeve member with the drive shaft and adapted to shear and permit rotation of the drive shaft relative to the sleeve member when the relative torque between the drive shaft and the sleeve member exceeds a predetermined level. In this embodiment, the resilient member is interposed the mounting socket of the propeller carrier and the sleeve member and forms the driving connection between the sleeve member and the propeller carrier. The resilient member is formed of an elastomeric material, such as rubber, and is molded on the sleeve member to form an integral unit therewith. This integral unit is then press-fitted into the mounting socket of the propeller carrier. Retainer means is mounted on the drive shaft for preventing axially outward movement of the sleeve member, and thus the propeller carrier, relative to the drive shaft when the drive pin has sheared.

Also in accordance with the preferred embodiment of the invention, the propeller carrier includes a hub end portion having a pair of longitudinally extending mounting shoulders oppositely spaced equidistant from the axis of rotation of the propeller carrier. The foldable propeller blades are adapted to be pivotally mounted upon the mounting shoulders by swivel pins.

In accordance with an alternate embodiment of the invention, the drive means further includes a drive member interposed the sleeve member and the mounting socket drivingly connecting the propeller carrier with the sleeve member for common rotation therewith. In this embodiment, the resilient member is interposed the drive member and the sleeve member and forms the driving connection between the drive member and the sleeve member.

One of the principal features of the invention is the provision of a foldable propeller assembly including a resilient means for absorbing reactive torque forces transmitted to the drive means when the foldable propeller blades move into the open operative position, thereby lessening the chance of shearing the drive pin to insure uninterrupted transmission of drive torque from the drive shaft to the propeller shaft.

Another of the principal features of the invention is the provision of a foldable propeller assembly including resilient means for absorbing reactive torque forces and thereby protecting the drive shaft from damage.

Still another of the principal features of the invention is the provision of a foldable propeller assembly including resilient means for absorbing reactive torque forces, which assembly is easily adapted to a conventional propeller assembly.

Other features and advantages of the embodiments of the invention will become apparent upon reviewing the following general description, drawings, and the appended claims.

Before explaining the invention in detail, it is to be understood that the invention is not limited in its application to the details of construction and arrangement of parts set forth in the following description or illustrated in the accompanying drawings, since the invention is capable of other embodiments and of being practiced or carried out in various ways. Also, it is to be understood that the phraseology or terminology employed herein is for the purpose of description and not of limitation.

GENERAL DESCRIPTION

Figure 1:
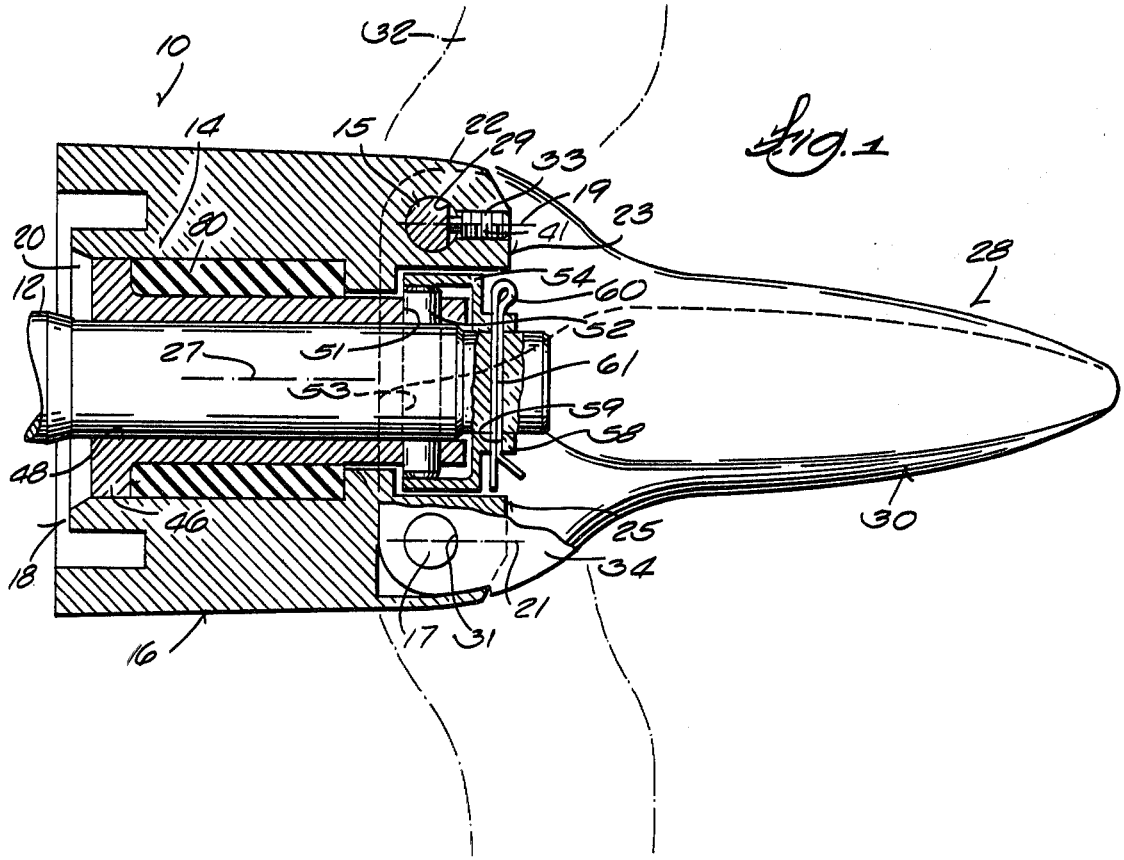
FIG. 1 is a sectional view of a foldable propeller assembly embodying various of the features of the invention.

A foldable propeller assembly 10 is shown in FIG. 1 which embodies various of the features of the invention. The assembly 10 is connected to a drive shaft 12 of a sailboat equipped with an auxiliary engine (not shown) that is used to power the boat when not under said. Basically, the assembly 10 includes drive means 14 connected with the drive shaft 12 for common rotation therewith and a propeller carrier 16 having an open end portion 18 defining an axially extending mounting socket 20 (see FIGS. 3 and 4).

Figure 2:
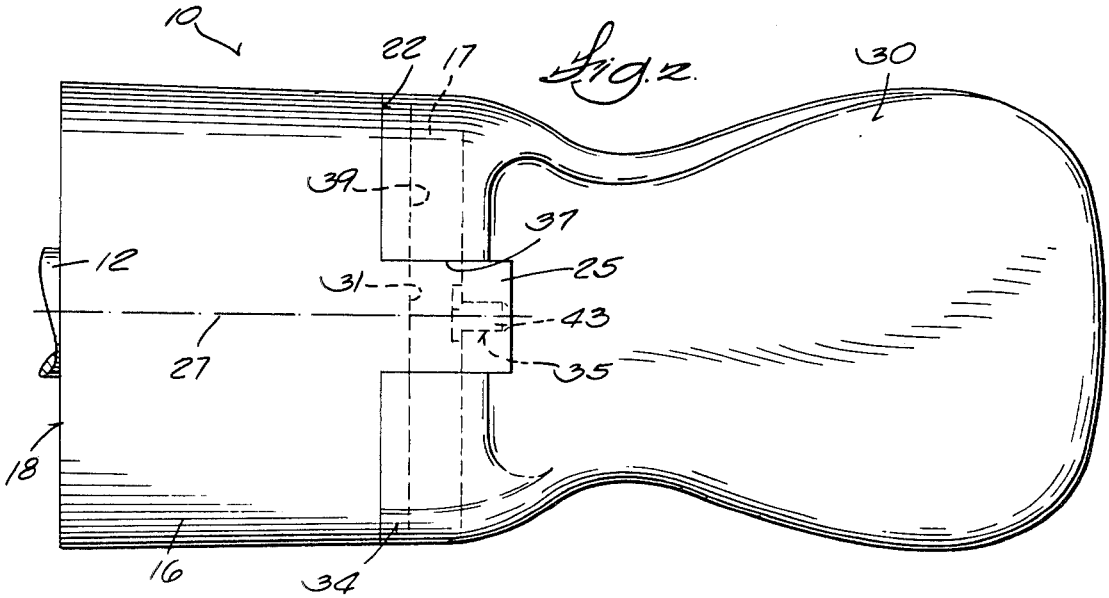
FIG. 2 is a side view of the foldable propeller assembly shown in FIG. 1.
Figure 3:
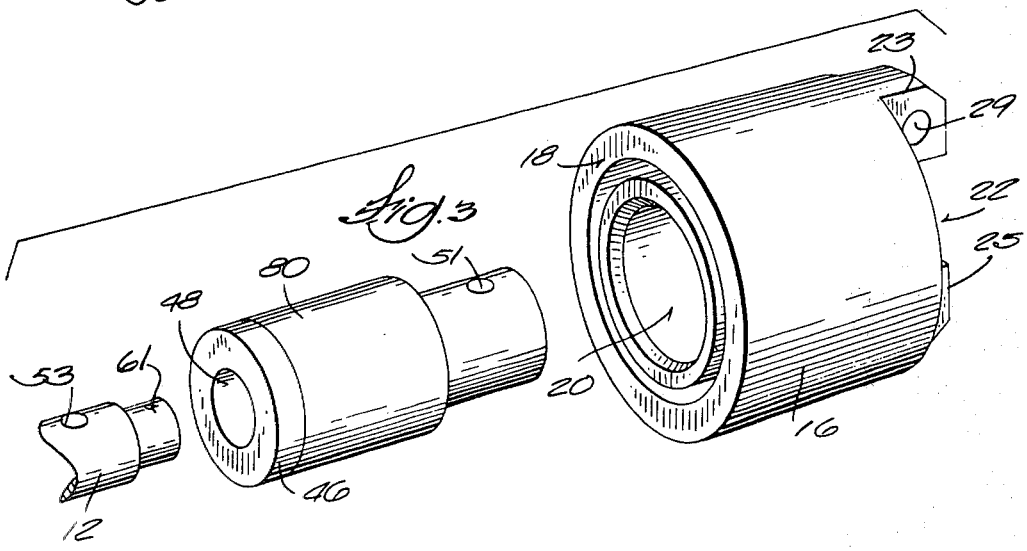
FIG. 3 is an enlarged perspective view of a portion of the drive assembly illustrated in FIGS. 1 and 2.

The propeller carrier further includes a hub end portion 22 having a pair of mounting shoulders 23 and 25 extending longitudinally from the hub end portion 22 (see FIGS. 2 and 3). The shoulders 23 and 25 are oppositely spaced equidistantly from the axis of rotation 27 of the propeller carrier 16 with the longitudinal axis 19 and 21 of each shoulder 23 and 25 running parallel to and in the same plane as the axis of rotation 27 of the propeller carrier 16. Each shoulder 23 and 25 includes a vertical bore 29 and 31 and an internally threaded longitudinal bore 33 and 35 which intersects the vertical bore 29 and 31.

A pair of foldable propeller blades 28 and 30 having inner ends 32 and 34 are provided. As shown in FIG. 2, each inner end includes a mounting slot 37 which is located along the longitudinal axis of each blade 28 and 30 and which adapts each blade 28 and 30 for pivotal mounting upon one of the mounting shoulders 23 and 25 by separate swivel pins 15 and 17 passing through a hole 39 provided in each blade 28 and 30 and through the vertical bore 29 and 31. A set screw 41 and 43 is threaded into each longitudinal bore 33 and 35 to contact the swivel pin 15 and 17 and prevent movement of the swivel pin 15 and 17 in the vertical bore 29 and 31.

So mounted, the blades 28 and 30 are pivotal between a collapsed folded-together position (shown by solid lines in FIG. 1) to a radially outward extending operative position (shown by dotted lines in FIG. 1) in response to centrifugal force created when the propeller carrier 16 is rotated. When rotation of the propeller carrier 16 ceases, the blades 28 and 30 move from the operative position to a collapsed, folded-together position in response to water pressure acting upon each blade 28 and 30. This collapsed, aft-trailing position offers minimal resistance to the forward movement of the boat when the auxiliary engine is not being used to power the boat, typically when the boat is under sail.

Means are provided for drivingly connecting the drive means 14, and thus the propeller carrier 16, with the drive shaft 12 for common rotation therewith. In the preferred embodiment illustrated in FIG. 1, the drive means 14 includes a sleeve member 46, typically a bronze bushing, having an axially extending bore 48 rotatably receiving the drive shaft 12. The sleeve member 46 is drivingly connected with the drive shaft 12 by a shear or drive pin 52 extending through a hole 51 provided at the outer portion of the sleeve member 46 and through a hole 53 provided in the drive shaft 12. The drive pin 52 is structurally designed to shear when the relative torque between the drive shaft 12 and the sleeve member 46 exceeds a predetermined level, permitting the sleeve member 46 to thereafter freely rotate relative to the drive shaft 12. In this way, the drive shaft 12 and the auxiliary engine are protected from damage caused by excessive torque.

Retainer means 54 mounted on the outer end portion of the drive shaft 12 prevents axially outward movement of the sleeve member 46 relative to the drive shaft 12 when the drive pin 52 shears. The retainer means 54 includes a cap 58 adapted to axially restrain the outer portion of the sleeve member 46 while allowing rotation of the sleeve member 46 relative to the cap 58 should the drive pin 52 shear. A conventional cotter pin 60 extends through the hole 59 provided in the cap 58 and through a hole 61 provided in the drive shaft 12 to secure the cap 58 to the end of the drive shaft 12 for common rotation therewith.

The sleeve member 46 is press-fitted into the mounting socket 20 of the propeller carrier 16 to drivingly connect the sleeve member 46 with the propeller carrier 16.

When the foldable propeller blades 28 and 30 are moved abruptly from the folded-together position to the outflung operative position in response to rotation of the propeller carrier 16, reactive torque forces are created. These reactive forces are transmitted from the propeller carrier 16 directly to the drive pin 52 through the sleeve member 46. These reactive forces can be of sufficient magnitude to shear the drive pin 52 and thus disable the propeller carrier 16.

This problem is lessened by providing a resilient member 80 which is interposed and drivingly connects the sleeve member 46 and the propeller carrier 16 together so as to absorb a portion of the reactive forces developed when the blades 28 and 30 are moved to the operative position, and thus reduce the magnitude of the reactive force ultimately transmitted to the drive pin 52. While the resilient member 80 may be of various forms and can be mounted between the sleeve member 46 and the propeller carrier 16 in various suitable manners, in the preferred embodiment illustrated in FIGS. 1 and 3, the resilient member 80 is formed from an elastomeric material, such as rubber, and is integrally molded on the sleeve member 46 to form an integral unit, which is then press-fitted into the propeller carrier 16 to provide a driving connection between the sleeve member 46 and the propeller carrier 16.

The resilient member 80 permits limited rotational movement of the propeller carrier 16 relative to the sleeve member 46. Consequently, the magnitude of the reactive torque ultimately transmitted to the drive pin 52 when the blades 28 and 30 are moved to their open operative position is reduced, with the resultant reduction in the frequency in the unwanted shearing of the drive pin 52.

Figure 6:
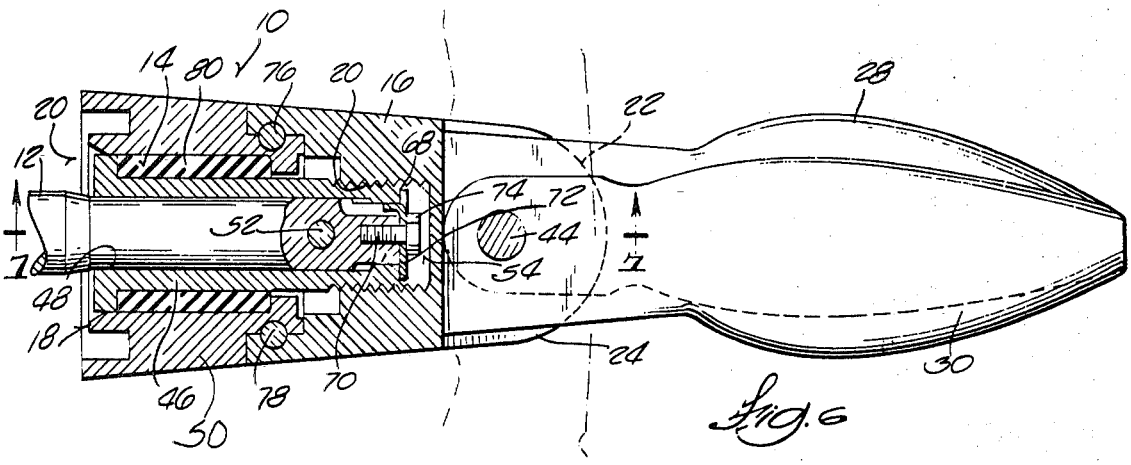
FIG. 6 is a fragmentary sectional view of another alternate construction of a foldable propeller assembly.
Figure 4:
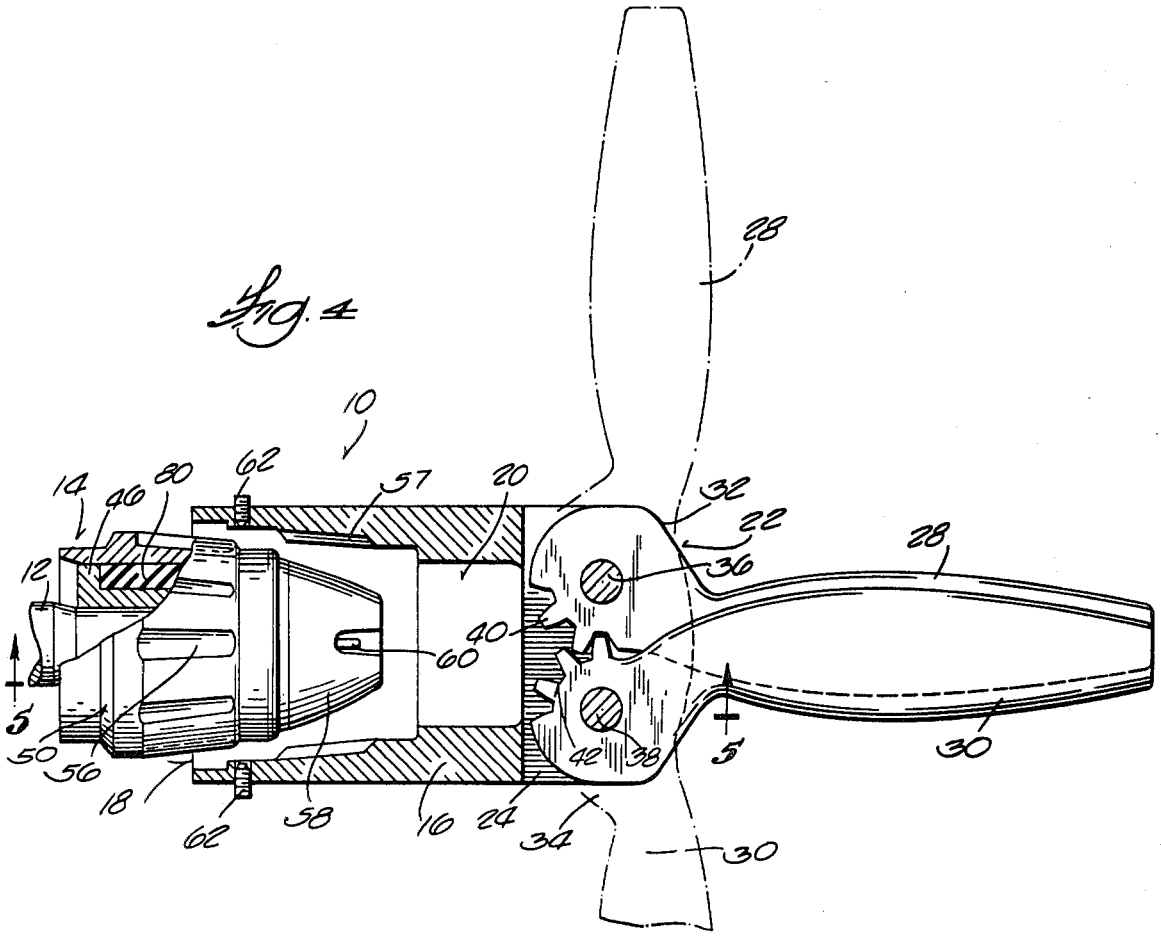
FIG. 4 is a fragmentary sectional view of an alternate construction of a foldable propeller assembly in which the propeller carrier is displaced from the installed position.

FIGS. 4 and 6 illustrate alternate constructions of the propeller assembly 10 in which the invention is equally applicable. Components which are common to the preferred embodiment illustrated in FIGS. 1 and 2 are assigned common reference numerals.

Figure 5:
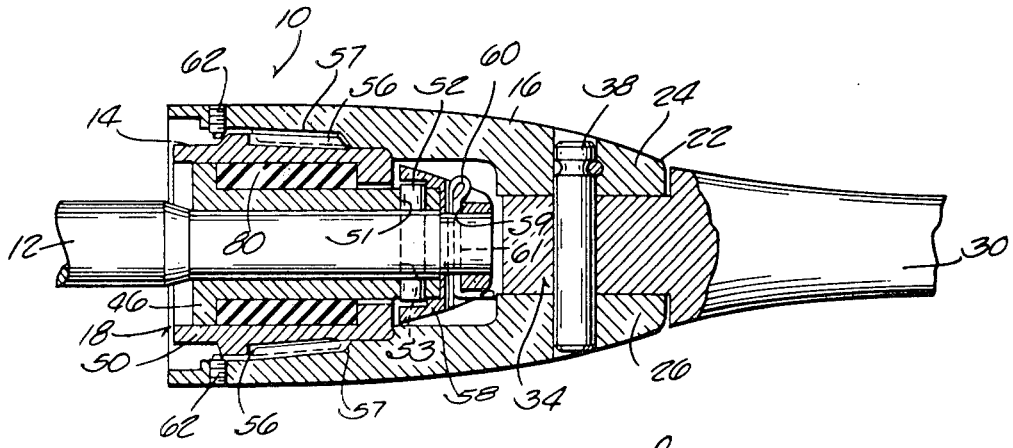
FIG. 5 is a sectional view of a foldable propeller assembly in the installed position taken generally along line 5—5 in FIG. 4.

In the alternate embodiment shown in FIGS. 4 and 5, the propeller carrier 16 includes a hub end portion 22 having a pair of spaced ears or bifurcations 24 and 26 for pivotally accommodating a pair of foldable propeller blades 28 and 30. The inner end 32 and 34 of each blade 28 and 30 is pivotally mounted within the bifurcations 24 and 26 by separate swivel pins 36 and 38. The inner end 32 and 34 of each blade 28 and 30 further includes a gear wheel segment 40 and 42. The gear wheel segments 40 and 42 mesh with each other so that the blades 28 and 30 pivot simultaneously about their respective swivel pins 36 and 38. In this embodiment, the drive means 14 further includes a drive member 50 having a plurality of external splines 56 generally spaced about its exterior diameter. The mounting socket 20 of the propeller carrier 16 includes a plurality of internal splines 57 which slidably receive the external splines 56 on the drive member 50 to drivingly connect the drive member 50 with the propeller carrier 16. One or more set screws 62 threaded through the propeller carrier 16 adjacent the open end portion 18 and biting a spline 56 on the drive member 50 prevent axially outward movement of the propeller carrier 16 relative to the drive member 50. In this arrangement, the resilient member 80 is mounted between the sleeve member 46 and the drive member 50 and forms the driving connection between the drive member 50 and the sleeve member 46.

Figure 7:
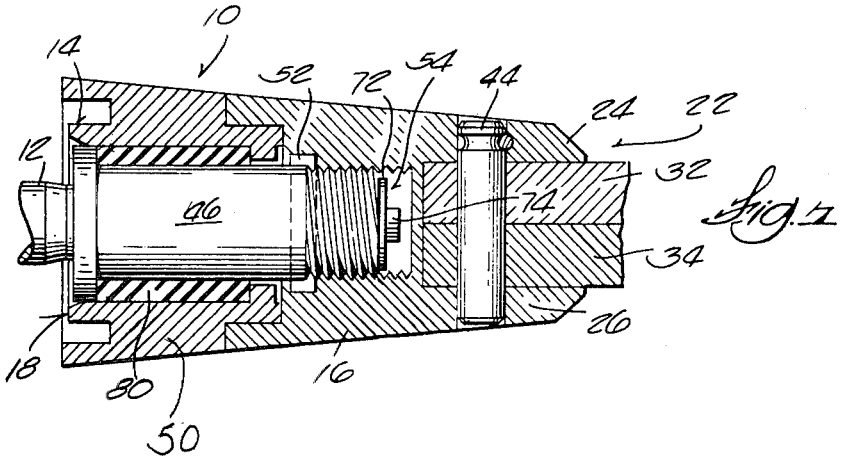
FIG. 7 is a sectional view taken generally along line 7—7 in FIG. 6.

In another embodiment shown in FIGS. 6 and 7, the propeller carrier 16 also includes a hub end portion 22 having a pair of spaced ears or bifurcations 24 and 26 pivotally accommodating a pair of foldable propeller blades 28 and 30. However, unlike the embodiment shown in FIGS. 4 and 5, the inner ends 32 and 34 of the blades 28 and 30 in this embodiment are pivotally mounted by a single swivel pin 44 so that the blades 28 and 30 pivot simultaneously about a common axis. Also in this embodiment, the end of the sleeve member 46 forms an internal shoulder 68 which is generally positioned in alignment with the end of the drive shaft 12 when the drive pin 52 drivingly connects the sleeve member 46 with the drive shaft 12. In this embodiment, the end of the drive shaft 12 includes an internally threaded bore 70. A tab washer 72 with a diameter approximating the diameter of the shoulder 68 is affixed to the end of the drive shaft 12 by a threaded bolt 74 that is threadably received into the internal bore 70 of the drive shaft 12. The tab washer 72 and the bolt 74 act as the retainer means 54. Also in this embodiment, the end portion of the sleeve member 46 is externally threaded and, correspondingly, the mounting socket 20 is internally threaded and adapted for being threadably received upon the threaded portion of the sleeve member 46. A pair of pins 76 and 78 pass through the propeller carrier 16 and the drive member 50 to prevent the propeller carrier 16 from unthreading itself off of the sleeve member 46 during rotation.

It is to be appreciated that the three embodiments described are not intended to show mutually exclusive constructions. Conventional foldable propeller assemblies are capable of many variations combining various elements of the three illustrated embodiments. The invention, of course, is applicable in these constructions as well.

Various of the features of the invention are set forth in the following claims.

What is claimed is:

1. A foldable propeller assembly adapted for connection to a drive shaft, said propeller assembly comprising a propeller carrier having an open end portion defining an axially extending mounting socket for receiving the drive shaft and including a forwardly located portion and rearwardly located portion of lesser size than said forwardly located portion so as to define therebetween a shoulder, said propeller carrier also including a hub end portion spaced from said open end portion, a pair of propeller blades pivotally mounted on said hub end portion for movement from a folded-together, collapsed position to a radially outwardly extending operative position in response to rotation of said propeller carrier and for movement from the operative position to the collapsed position in response to cessation of rotation of said propeller carrier, and drive means for drivingly connecting said propeller carrier with the drive shaft for common rotation therewith, said drive means including a sleeve member having an axially extending bore for rotatably receiving the drive shaft, a shear pin located in said rearward portion of said mounting socket and drivingly connecting said sleeve member and the drive shaft for common rotation, a drive member releaseably receivable in said forwardly located portion of said socket in engagement with said shoulder so as to limit inward receipt of said drive member into said socket and in rotary driving connection with said propeller carrier so as to drivingly connect said propeller carrier with said drive member for common rotation and so as to enable disconnection of said propeller carrier from said drive member without affecting the connection between said sleeve member and the drive shaft by said shear pin, and a resilient member interposed said drive member and said sleeve member for establishing driving connection between said sleeve member and said drive member and for absorbing torque forces transmitted between said propeller carrier and the drive shaft.

2. A foldable propeller assembly according to claim 1 wherein said drive member includes a plurality of external splines and wherein said mounting socket includes a plurality of internal splines receiving said external splines and drivingly connecting said propeller carrier with said drive member for common rotation therewith.

3. A foldable propeller assembly according to claim 2 and further including one or more set screws securing said propeller carrier to said drive member to prevent axially outward movement of said propeller carrier relative to said drive member.

4. A foldable propeller assembly according to claim 1 wherein said mounting socket includes an internally threaded portion, and wherein said sleeve member includes an externally threaded outer end portion threadably receiving said mounting socket threaded portion.

5. A foldable propeller assembly according to claim 4 and including pin means interposed said drive member and said propeller carrier.

6. A foldable propeller assembly adapted for connection to a drive shaft, said propeller assembly comprising a propeller carrier having an open end portion defining an axially extending mounting socket for receiving the drive shaft and including a forwardly located portion and a rearwardly located portion of lesser size than said forwardly located portion so as to define therebetween a shoulder, said propeller carrier also including a hub end portion spaced from said open end portion, a pair of propeller blades pivotally mounted on said hub end portion for movement from a folded-together, collapsed position to a radially outwardly extending operative position in response to rotation of said propeller carrier and for movement from the operative position to the collapsed position in response to cessation of rotation of said propeller carrier, a sleeve member having an axially extending bore for rotatably receiving the drive shaft, a drive pin located within said rearwardly located portion of said mounting socket and drivingly connecting said sleeve member with the drive shaft and adapted to shear and permit rotation of the drive shaft relative to said sleeve member when the torque between the drive shaft and said sleeve member exceeds a predetermined level, retainer means mounted on the drive shaft within said rearwardly located portion of said mounting socket for preventing radial outward movement of said drive pin, a drive member releasably receivable in said forwardly located portion of said socket in engagement with said shoulder so as to limit inward receipt of said drive member into said socket and in rotary driving connection with said propeller carrier so as to drivingly connect said propeller carrier with said drive member for common rotation therewith and so as to enable disconnection of said propeller carrier from said drive member without affecting the connection between said sleeve member and the drive shaft by said drive pin, and a resilient member formed from an elastomeric material interposed said drive member and said sleeve member and forming the driving connecting between said drive member and said sleeve member, said resilient member absorbing torque forces transmitted between said propeller carrier and said sleeve member.

7. A foldable propeller assembly according to claim 6 wherein said elastomeric material is molded on said sleeve member to form an integral unit which is press-fitted into said drive member.

8. A foldable propeller assembly according to claim 7 wherein said elastomeric material is rubber.

9. A foldable propeller assembly according to claim 8 wherein said drive member includes a plurality of external splines and wherein said mounting socket includes a plurality of internal splines receiving said external splines and drivingly connecting said propeller carrier with said drive member for common rotation therewith, and further including one or more set screws securing said propeller carrier to said drive member to prevent axially outward movement of said propeller carrier relative to said drive member.

10. A foldable propeller assembly according to claim 8 wherein said mounting socket includes an internally threaded portion, and said sleeve member includes an externally threaded outer portion threadedly receiving said mounting socket threaded portion and pin means interposed said drive member and said propeller carrier.

* * * * *